United States Patent [19]

Busch

[11] 4,129,299

[45] Dec. 12, 1978

[54] APPARATUS FOR HIT SCORING TARGETS

[75] Inventor: Theodore N. Busch, Minneapolis, Minn.

[73] Assignee: Caswell Equipment Company, Minneapolis, Minn.

[21] Appl. No.: 767,841

[22] Filed: Feb. 11, 1977

[51] Int. Cl.[2] ..... A63B 63/02; A63B 69/00

[52] U.S. Cl. ..... 273/102.2 S

[58] Field of Search ..... 273/102.2 R, 102.2 S, 273/184 R, 102.2 A, 102 S

[56] References Cited

U.S. PATENT DOCUMENTS

| | | | |
|---|---|---|---|
| 2,185,628 | 1/1940 | Daum | 273/102.2 R |
| 2,749,125 | 6/1956 | Ream | 273/102.2 A |
| 3,392,979 | 7/1968 | Wilska | 273/102.2 S |
| 3,737,166 | 6/1973 | Knight | 273/102.2 S |
| 3,814,438 | 6/1974 | Baron et al. | 273/185 R |
| 3,819,962 | 6/1974 | Ivey et al. | 273/102.2 R |

*Primary Examiner*—Robert W. Michell
*Assistant Examiner*—Arthur S. Rose
*Attorney, Agent, or Firm*—Schroeder, Siegfried, Ryan, Vidas & Steffey

[57] ABSTRACT

A target scoring apparatus for detecting hits on a target regardless of location of the hits and inhibiting the effect of hits on the target holder assembly which includes the location of a sensor on the target holder assembly to inhibit the signal which may be generated from the target sensor from being recorded on the recording device when the target holder assembly is hit.

12 Claims, 4 Drawing Figures

APPARATUS FOR HIT SCORING TARGETS

My invention relates to a target scoring apparatus and more particularly to an improved target scoring apparatus for remotely scoring hits on targets by fire arms for training and shooting sports.

Scoring of targets automatically is generally old. In the past, both electronic and impact type sensing have been utilized. The electronic method or electrical method has incorporated a special target with conductors therein separated by a dielectric material which when penetrated by a bullet provides a signal in terms of a circuit closure to a remotely positioned recording or counting apparatus. Bullets or missiles passing through the target short the conductive layers to provide the usable hit signal output. This type of scoring requires special targets, special mounting of the targets and is a relatively expensive means for automatically scoring of fire arms shooting.

The impact method previously used employed a variety of inertial switches to respond to shock waves caused by a missile or bullet passing through the target. This type of approach permitted the use of a standard target without special preparation of wiring, but had the disadvantage that the target supporting apparatus or holder, if hit, would generate shock waves sufficient to operate the inertial switches and provide erroneous hit signals. To overcome this objection, special holders and installations were required which shielded the target support apparatus from the possible impact by the bullet. Additionally, experimentation has been conducted trying to improve impact sensors that are capable of being finely adjusted to detect the desired shock waves but reject the unwanted ones, all without success.

The present invention is directed to the use of a target scoring apparatus utilizing the impact type sensor, which permits the use of a standard target and standard target holder. With the improved target scoring apparatus, hits on the supporting target holder prevent operation of the associated recorder or counter even though the target sensor may be activated as a result of the shock waves generated by the miss. The improved target scoring apparatus permits the use of a conventional impact type sensor without fine calibration, such that simplified inertial switches with simplified switching circuits may be connected into an electronic circuit to provide scoring on a hit or miss basis.

Therefore, it is an object of this invention to provide an improved target scoring apparatus.

Another object of this invention is to provide an improved target scoring apparatus which inhibits reaction of hits on the target support.

A further object of this invention is to provide an improved target scoring apparatus which is economical to build and maintain and easy to use and install.

These and other objects of the invention will become apparent from the reading of the following detailed description together with the drawings wherein.

Figure 1:
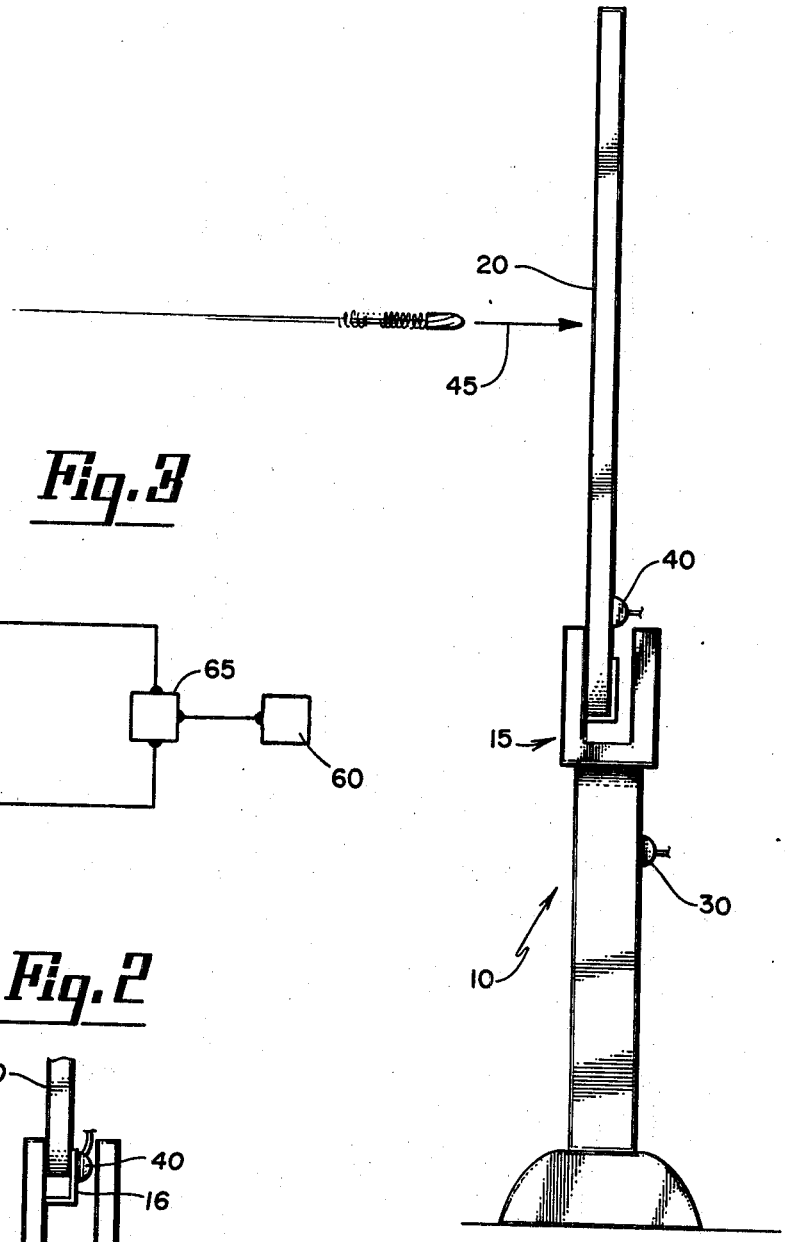
FIG. 1 is a schematic view of a target holder and target showing the location of sensors thereon.

My improved target scoring apparatus is shown schematically in FIG. 1 as incorporating a target holding support indicated generally at 10. The support is shown schematically in FIG. 1, but it will be understood that it includes angled surfaces causing bullets to deflect into the impact areas, if struck. This support is placed on the range and does not require separate shielding. It is a relatively rigid structure designed to hold a target, indicated generally at 20, which target is of a penetrable type and has a low mass. Such targets are replaceable and are mounted in the target holding support in the holding section, indicated at 15. Associated with the target holding support is a first sensor, indicated in block at 30. When the term sensor is used herein it denotes an electrical component that reacts to a shock wave to either give off an electrical signal (a piezoelectric device) or which changes an electrical signal normally passing therethrough (an induction type pickup) or which opens and closes switch contacts to block or allow signals to pass through. As a wide variety of sensors are usable in the concept of the invention, the general principles will be described first.

Sensor 30 may be an inertial switch which has the electrical contacts in circuit with a logic and recorder circuitry. Mounted on the target is a second sensor 40 which sensor may also be an inertial switch. It detects impact and/or penetration of the bullet on the replaceable target. Sensor 40 forms a second part of an electrical circuit with the recorder circuitry.

The arrow, indicated by numeral 45, indicates the shooting direction from the range, with the target and holding support being down range from the shooting position. The improved target scoring apparatus is designed to detect hits on the target without reference to particular position of the impact on the target itself. It is designed, however, to discriminate between hits upon the support, and on the target, by virtue of the shock waves generated in the support which may affect the sensor associated with the target itself. Absent the present invention, this would give an improper scoring of a hit when it did not in fact hit the target.

Figure 2:
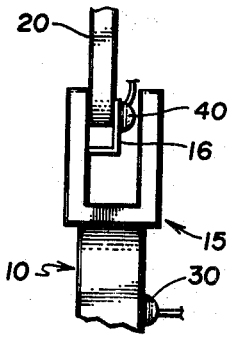
FIG. 2 is a schematic view of an alternate embodiment of the same.

In FIG. 2, as in FIG. 1, the holder support 10 includes a mounting bracket associated therewith, as indicated at 16, which clamps onto and holds the disposable and penetrable target 20. In FIG. 2, the sensor 30 is positioned on the holder support to respond to impacts on the support structure itself and the sensor 40 is mounted on the mounting bracket 16 for the target and hence, will be responsive to movement of the target within this clamping structure. Thus, sensor 40 is mounted on a part of the holder support as distinguished from on the target as shown in FIG. 1.

The concept of my invention is to use a first sensor 30 placed on the target holder support which might be subject to hits to act as an inhibit sensor. A second sensor 40 provides a signal whenever the target is hit and which may, undesirably, record a hit when the target holder support is struck. The inhibit sensor cancels any hit signal from the second sensor 40 in the event a signal is given therefrom when the target holder support is hit. Thus, the recording device only records true hits on the target.

Figure 3:
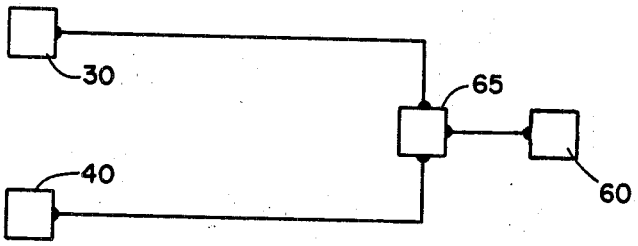
FIG. 3 is a schematic block diagram of the improved target scoring apparatus; and, FIG. 4 is a circuit diagram of the target scoring apparatus.

As will be seen in the schematic block diagram of FIG. 3, the sensors 30 and 40 are positioned remote from a circuit 65 and counter 60 which act together as a scoring apparatus. The circuit 65 combines the effects of the two sensors so that the operation of the sensor 30 may inhibit operation of the sensor 40 upon the scoring apparatus. A signal from an inhibit sensor responding to the shock waves picked up by a hit on the target support would reach the recorder and interrogation device before the signal from the target sensor preventing operation of the same. Therefore, any misdirected hit could be prevented from scoring, or could be scored separately as a foul or miss.

A hit on the support in most cases will generate severe shock waves which the target sensor could pick up. However, the logic circuit as shown in block diagram in FIG. 3 will prevent operation of the target sensor when a hit occurs on the holding support.

I have found that inertial switches used as target scoring sensors of the type manufactured by Caswell Equipment Company of Minneapolis, Minn. and identified as Hit Sensor Assembly Model 30-0006 are suitable for the purposes of hit detection and inhibit operation. Such target scoring sensors are particularly adapted for use in the improved target scoring apparatus when combined with a counter or recorder of the type manufactured by Banner Engineering Company of Minneapolis, Minn., under the name of Alpha Numeric Counter, Model 92.

Figure 4:
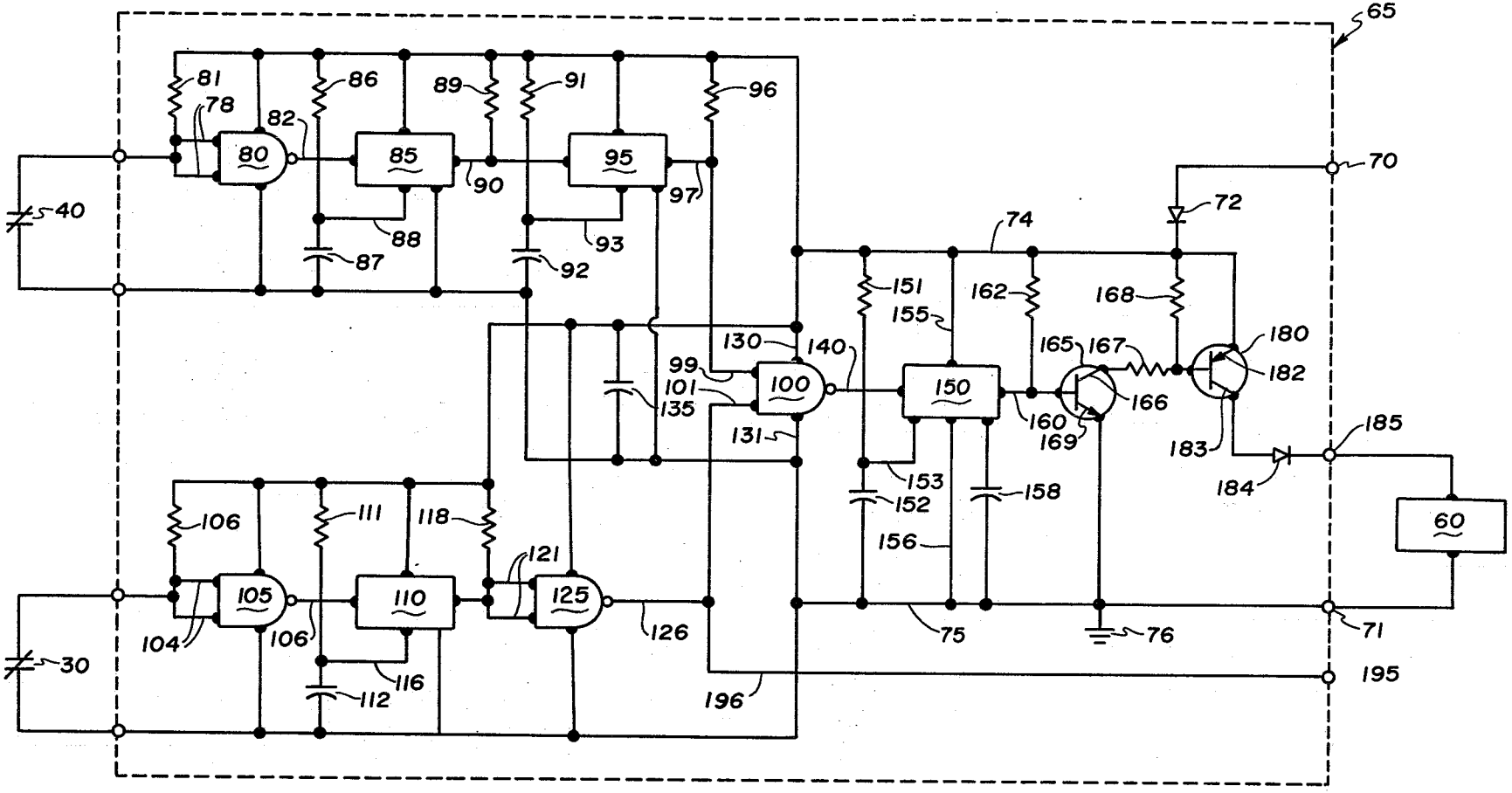

FIG. 4 shows a schematic circuitry diagram for distinguishing between hits on a target and hits on a holder support.

The circuitry utilizes circuit elements 80, 100, 105, and 125, each of which is a two input NAND gate. Four such elements are manufactured in a single package identified by the manufacturer, Motorola, Inc., as an "MC672 quad two input NAND gate (active pullup)." The DC power to the MC672 package is normally applied to two pins, although it is shown in FIG. 4 as being applied to each of the gates. For example, power is applied to NAND gate 100 by means of conductors 130 and 131 which are connected respectively to the positive DC bus 74 and the ground bus 75. NAND gates such as 80, 100, 105, and 125, produce a zero output on an output line such as 140 of gate 100, only when a positive voltage is applied to both input terminals by means of conductors such as 99 and 101. If either of the inputs of NAND gate 100 is a low voltage characteristic of a logic 0, the output of NAND gate 100 will be a logic 1, i.e., a positive DC voltage.

The other integrated circuit elements utilized in FIG. 4 are non-retriggerable one-shot units shown in block form as elements 85, 95, 110, and 150. Suitable non-retriggerable one-shots are packaged in a single package by Signetics Corporation and identified as a type number NE553. In a typical element such as block 85, the steady state output on conductor 90 will be a logic 0, providing a path to ground through resistor 89 from positive DC bus 74. When block 85 is triggered by a change in its input on conductor 82 from a positive DC voltage to a zero DC voltage, a positive voltage appears at the output connected to conductor 90 for a time duration $T_1$ controlled by the values of resistor 86 and capacitor 87. After the preset time interval $T_1$ has elapsed, the output voltage of block 85 returns to zero.

The circuit of FIG. 4 utilizes NAND gates and non-retriggerable one-shots to delay transmission of the signal from the target sensor 40 to counter 60 for a time sufficient to permit the circuitry to determine whether sensor 30, connected to support 10, was also actuated, thereby indicating a hit on support 10 rather than on target 20 alone. The circuitry in FIG. 4 accomplishes this by connecting the contacts of switch 40 through conductors 78 to both inputs of NAND gate 80 and through resistor 81 to the positive DC bus 74. In this configuration, NAND gate 80 acts as an inverter, having a positive DC output voltage output on conductor 82 when switch 40 is closed and switching to a zero level output when switch 40 is momentarily opened to indicate the detection of an impact. When the output of NAND gate 80 on conductor 82 switches from a positive to a zero voltage, it initiates operation of one-shot 85 to produce an output pulse on conductor 90 having a time duration $T_1$. At the termination of pulse $T_1$, the switching of the voltage on conductor 90 from a positive to a zero level initiates a pulse from block 95 on conductors 97 and 99 which has a predetermined time duration $T_2$ controlled by the values of resistor 91 and capacitor 92. Thus, the signal on conductor 99, one of the two inputs to NAND gate 100, is a positive voltage pulse having a duration $T_2$ which is received following a delay $T_1$ after the first momentary opening of normally closed switch 40. In addition to delaying the generation of the pulse signal to the input of NAND gate 100, circuit 85, since it responds solely to the first change in state of the output of NAND gate 80, acts to produce only a single pulse at the input of NAND gate 100 even though the contacts of sensor switch 40 may normally experience considerable "bounce," i.e., repetitive opening and closing, in response to bullet impact upon target 20.

The other input to NAND gate 100 at conductor 101 is produced by the signal from sensor 30. When the contacts of sensor 30 are momentarily opened, they switch the voltage at conductors 104 to NAND gate 105 from a ground level to a positive DC voltage, thereby switching the output of NAND gate 105 on conductor 106 from a positive DC voltage to a zero level, to thereby trigger circuit 110 to produce a positive output pulse on conductors 121 for a time duration $T_3$ determined by the values of resistor 111 and capacitor 112. The time constant $T_3$ is selected such that it is considerably longer than the sum of time durations $T_1$ and $T_2$. The pulse at the output of circuit 110 is inverted by NAND gate 125 and therefore appears on conductor 126 and conductor 101 as an excursion from a positive steady state voltage to a zero level having a time duration $T_3$. Thus, in the situation where both sensors 30 and 40 are actuated by a bullet striking target support 10 and actuating both switches 30 and 40, a zero level signal is applied to the input of NAND gate 100 which is connected to conductor 101 for a time duration $T_3$. That zero level signal at the input of NAND gate 100 forces the output of that NAND gate at terminal 140 to remain as a positive voltage irrespective of the receipt at the other input of NAND gate 100 of a positive voltage pulse which is received following actuation of sensor 40 following a time delay $T_1$. Since $T_3$ exceeds the sum of both $T_1$ and $T_2$, the output of NAND gate 100 on conductor 140 is, therefore, inhibited from changing its condition to improperly indicate a valid hit being scored on target 20.

In the event of a hit on target 20 alone, only sensor 40 is actuated, and the positive voltage pulse from circuit 95 is applied to conductor 99 and one of the inputs of NAND gate 100 while the steady state positive voltage from NAND gate 125 is being applied to the other input, thereby allowing the output of NAND gate 100 to switch from its steady state positive value to a zero value for a time interval $T_2$. The negative excursion of the voltage on conductor 140 actuates circuit 150 to produce a positive voltage output pulse on conductor 160 which has a time duration $T_4$ determined by the values of resistor 151 and capacitor 152. The positive pulse at the output of delay circuit 150 turns transistor 165 on which in turn turns transistor 180 on to drive a current pulse through diodes 184 and terminal 185 to the counter 60. The time duration $T_4$ is selected to produce a long time duration output pulse for counter 60 to avoid any multiple counting of a single impact which might otherwise occur due to contact bounce.

Thus, as described above, the circuit of FIG. 4 provides a single pulse to counter 60 upon actuation of switch 40 to respond to a hit on target 20. In the event that the frame 10 is struck by a bullet, an additional sensor 30 which is responsive to a hit on frame 10, is utilized to generate an inhibit signal which conditions the circuit to be insensitive to the delayed signal indicative of actuation of switch 40. The circuit also provides, on conductor 196 and terminal 195, a further input terminal for receiving an inhibit signal from further circuitry, not shown, to cause gate 100 to reject a "hit" indication from sensor 40. That signal can be used, if desired, to actuate other circuitry to provide a positive indication that the frame was struck.

While I have shown the invention herein in connection with a schematic electronic circuit and appropriate impact type sensors to operate the scoring apparatus and to perform the inhibit function, it will be recognized that other types of hit sensors may be employed in a similar type of circuit to perform the same function.

Therefore, in considering this invention, it should be remembered that the present disclosure is illustrative only and the scope of the invention should be determined by the appended claims.

What I claim is:

1. A target scoring apparatus comprising, a relatively rigid target holding support, means included on said support for releasably mounting a target thereon, a first sensor associated with the rigid target holding support having a predetermined output when a bullet impacts on said support; a second sensor associated with the target, said second sensor having a predetermined output when the target is struck by a bullet; counter means for counting bullet impacts upon said target; and circuit means coupling said first and second sensors with said counter means such that said first sensor inhibits operation of the counter under conditions of said predetermined output.

2. The target scoring apparatus of claim 1 in which the first and second impact sensors are inertial switches.

3. The target scoring apparatus of claim 1 in which the second impact sensor is included in the mounting means of the target on the target holder support.

4. The target scoring apparatus of claim 1 in which the second impact sensor is mounted within the target holding support to contact the target.

5. The target scoring apparatus of claim 1 in which the first sensor is mounted on the target holding support and responsive to shock waves generated by impact of a bullet on the support.

6. The target scoring apparatus of claim 5 in which the second sensor is mounted on the target holding support and associated with the target to respond to movement of the target upon impact of the bullet thereon.

7. The target scoring apparatus of claim 6 in which the first and second sensors have respectively normally closed conduits connected in the circuit means to control the operation of the counter means.

8. A target scoring apparatus comprising, a first impact sensor adapted to be mounted on a target holder support, said first impact sensor having a normally closed contact which is adapted to open when a bullet impacts on the support; a second impact sensor adapted to be associated with a target mounted in the target holder support, said second impact sensor having a normally closed contact which is adapted to open when the bullet impacts on the target; and circuit means including a recorder and means for generating signals with the opening of each of the normally closed contacts of said first and second impact sensor, said circuit means including further means for modifying the signal generated by the opening of the contact of the first impact sensor to inhibit the operation of the recorder.

9. The target scoring apparatus of claim 8 in which the signal generating means are nand gates.

10. The target scoring apparatus of claim 9 in which the further means of the circuit means are delay devices which shift the time of the target impact signal to later than the time of a target holder impact signal to prevent operation of the recorder.

11. In a system for scoring hits on a frame mounted target which includes a first sensor for detecting a projectile impact upon said target and providing a signal indicative thereof and which also includes hit indicator means for receiving the output from said sensor and producing a hit indication, the improvement which prevents projectile impacts on said frame from producing a hit indication comprising:

a second sensor mounted on said frame to detect a projectile impact upon said frame and providing a signal indicative thereof;

time delay means connected to receive the signal from said first sensor for delaying transmission of the output from said first sensor to an output terminal of said time delay means; and inhibit means connected to receive the output from the output terminal of said time delay means and selectably transmit it to said hit indicator means, said inhibit means also connected to receive a signal from said second sensor indicative of an impact on said frame and when said signal from said second sensor is received, said inhibit means blocks transmission of the output from said time delay means to said hit indicator means.

12. A system for scoring hits on a frame mounted target comprising:

first impact sensing means mounted to respond to impacts on said target and said frame;

second impact responsive means mounted to respond only to hits on said frame; and hit recording means connected to said first impact sensing means and said second impact sensing means for registering hits only when said first impact sensing means senses an impact and said second impact sensing means does not sense an impact.

* * * * *

UNITED STATES PATENT AND TRADEMARK OFFICE

CERTIFICATE OF CORRECTION

PATENT NO. : 4,129,299

DATED : December 12, 1978

INVENTOR(S) : Theodore N. Busch

It is certified that error appears in the above-identified patent and that said Letters Patent are hereby corrected as shown below:

Column 1, line 25, delete "of" and insert therefore --or--.

Column 3, line 42, delete "of" and insert therefore --to--.

Claim 9, line 2, delete "nand" and insert therefore --NAND--.

Signed and Sealed this

Tenth Day of April 1979

[SEAL]

Attest:

RUTH C. MASON
Attesting Officer

DONALD W. BANNER
Commissioner of Patents and Trademarks